US006442358B1

(12) United States Patent
Regelsberger et al.

(10) Patent No.: US 6,442,358 B1
(45) Date of Patent: Aug. 27, 2002

(54) ELECTROPHOTOGRAPHIC MARKING MACHINE INCLUDING A CONTROLLER FOR THE SELECTIVE INTERRUPTION AND RESTART OF A PRINT MODE OPERATION AND METHOD

(75) Inventors: Matthias Regelsberger, Rochester; David E. Hockey, Brockport, both of NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/572,521

(22) Filed: May 17, 2000

(51) Int. Cl.[7] ..... G03G 15/00
(52) U.S. Cl. ..... 399/85; 399/15; 399/72
(58) Field of Search ..... 399/85, 87, 9, 399/15, 72

(56) References Cited

U.S. PATENT DOCUMENTS 4,099,860 A * 7/1978 Connin ..... 399/87
4,448,515 A * 5/1984 Ishikawa ..... 399/15
4,678,316 A * 7/1987 Abuyama ..... 399/87 X
4,708,461 A * 11/1987 Okuda et al. ..... 399/87
4,739,366 A 4/1988 Braswell et al. ..... 371/15 X
5,023,817 A 6/1991 Au et al. ..... 364/550
5,152,001 A * 9/1992 Hanamoto ..... 399/87 X
5,200,958 A 4/1993 Hamilton et al. ..... 371/16.4
5,243,382 A 9/1993 Takano et al. ..... 355/207
5,347,346 A 9/1994 Shimizu et al. ..... 355/202
5,539,499 A 7/1996 Fujisawa ..... 355/206
5,596,390 A 1/1997 Sawada ..... 399/8
5,740,490 A 4/1998 Yamashita et al. ..... 399/8
5,946,521 A 8/1999 Budnik et al. ..... 399/24
5,956,544 A 9/1999 Stern et al. ..... 399/73
6,038,417 A 3/2000 Nagamine et al. ..... 399/125
6,052,551 A 4/2000 De Cock et al. ..... 399/296

* cited by examiner

*Primary Examiner*—Fred L. Braun

(57) ABSTRACT

An eletrophotographic marking machine and electrophotographic process wherein the machine has a logic and control unit programed to complete a print mode operation wherein an image recording member such as a belt is moved past a series of workstations in a print mode operation, the control unit being configured to permit a process isolation that interrupts the print mode operation of the machine without causing a hard stop of the machine. The controller is further configured to allow the restart of the interrupted print mode operation from the point of stoppage so the interrupted print mode can be completed.

8 Claims, 3 Drawing Sheets

ELECTROPHOTOGRAPHIC MARKING MACHINE INCLUDING A CONTROLLER FOR THE SELECTIVE INTERRUPTION AND RESTART OF A PRINT MODE OPERATION AND METHOD

FIELD OF THE INVENTION

The present invention relates to the maintenance and operation diagnosis of an electrophotographic marking machine, and more particularly, to the selective interruption of an electrophotographic marking process during a normal print mode and a subsequent reconfiguration to the normal print mode.

BACKGROUND OF THE INVENTION

Electrophotographic marking machines such as copiers and printers require various kinds of maintenance, such as replenishment of toner and paper to maintain their designed copying functions. Further, as these devices become more complex and versatile, the interface between the machine and the service representative must be expanded if complete and efficient trouble shooting of the machine is to be realized.

Diagnostic methods often require that a service representative perform an analysis of the problem. For example, problems with paper movement in a machine can occur in different locations and occur because of various machine conditions or failure of various components. A difficulty with prior diagnostic services is the inability to easily and automatically pinpoint the precise parts or subsystems in a machine causing a malfunction or deteriorating condition.

Therefore, a need exists for an electrophotographic marking machine that can be selectively controlled to provide an analysis and examination of image formation steps prior to completion of the electrophotographic process. The need further exists for such interruption of the electrophotographic process at predetermined steps, wherein a reconfiguring procedure is implemented to return the machine to a user operable mode.

SUMMARY OF THE INVENTION

The present invention provides an electrophotographic processing control to isolate the various image formation steps and paper handling steps. Thus, the cause of image artifacts generated during image formation (such as smears, lack of density, mottle) and problems in paper handling of the transport system (such as folded corners, edge damage), can be correctly identified and efficiently corrected. The present invention also permits isolation of steps in the paper path from feeding to finishing.

In a first configuration, the invention includes an electrophotographic marking machine having a logic and control unit configured to stop a print mode at a predetermined point prior to completion of the print mode, without invoking hard or emergency stop configuration of the marking machine. The predetermined point may correspond to one of a number of copies, a time, or a position in the paper path. The logic and control unit is selected to provide a recovery sequence to return the marking machine to an operator intitiatable print mode.

The present invention further contemplates a method of operating an electrophotographic marking machine by selectively stopping a normal operating configuration of the electrophotographic marking machine while operating in a print mode at a predetermined point, prior to completion of the electrophotographic process, and subsequently reconfiguring the marking machine to an operator controlled print mode.

BRIEF DESCRIPTION OR THE DRAWINGS

DETAILED DESCRIPTION OF THE PREFERRED EMBODIMENT

Figure 1:
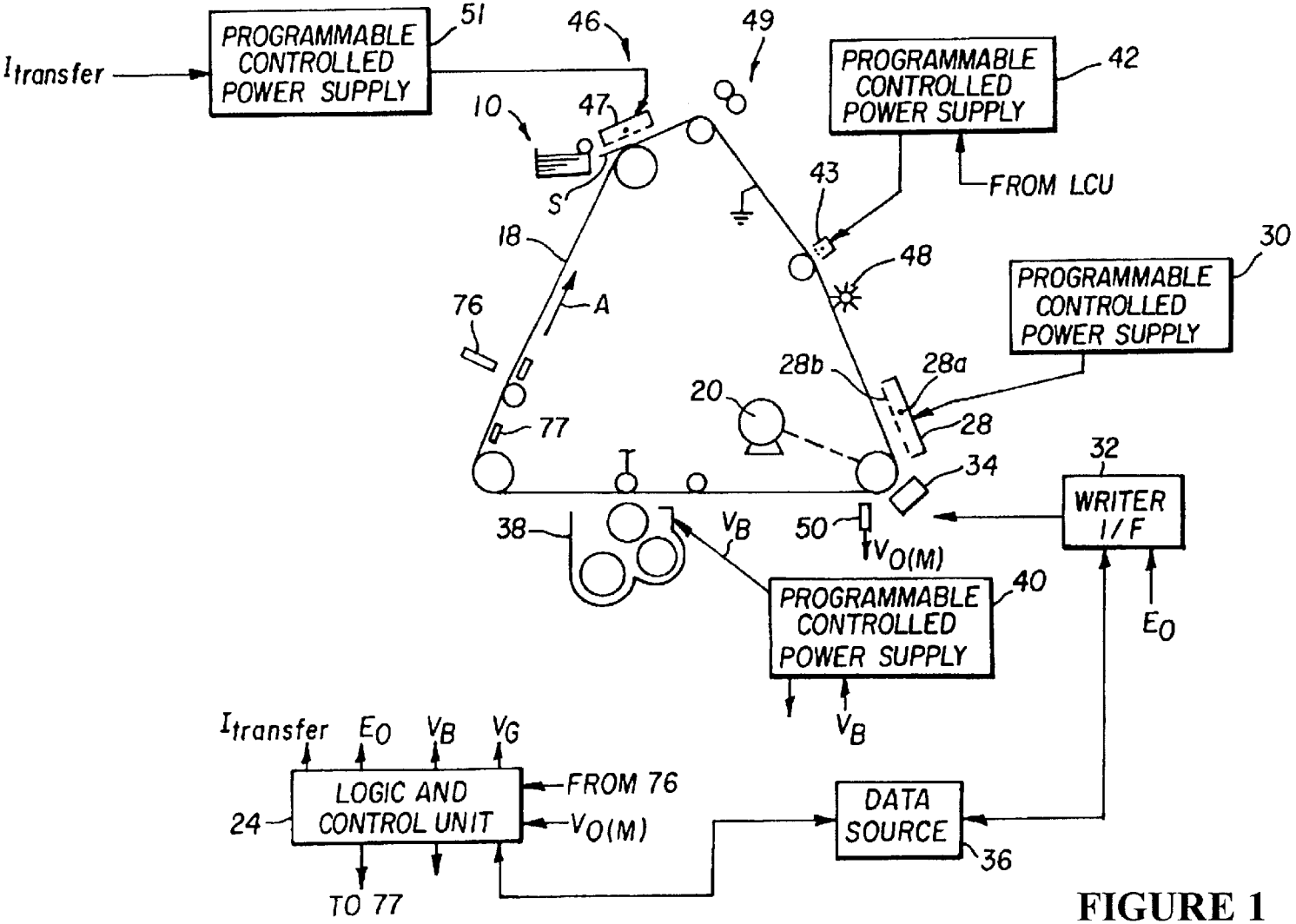
FIG. 1 is a side elevational view in schematic of an exemplary electrophotographic marking machine with which the present invention may be practiced.

Referring to FIG. 1, an electrophotographic marking machine 10 is shown. The present invention is described in the environment of a particular electrophotographic marking machine such as a copier and/or a printer. However, it will be noted that although this invention is suitable for use with such machines, it also can be used with other types of electrophotographic copiers and printers. For purposes of the description, the electrophotographic marking machine 10 includes the paper path from paper feeding to finishing. In addition, the term paper is meant to include sheets, rolls or webs of paper, transparencies, composites or laminates.

Because devices of the general type described herein are well known the present description will be directed in particular to elements forming part of, or cooperating more directly with, the present invention.

To facilitate understanding of the foregoing, the following terms are defined:

$V_0$=Primary voltage (relative to ground) on the photoconductor as measured just after the primary charger.

This is sometimes referred to as the "initial" voltage.

$V_{0(m)}$=the averaged (mean) value of individual $V_0$ values.

$V_B$=Development station electrode bias.

With reference to the electrophotographic marking machine 10 as shown in FIG. 1, a moving image recording member such as photoconductive belt 18 is trained about a plurality of rollers, one of which is driven by a motor to drive the belt past a series of work stations of the printer. The recording member may also be in the form of a drum. A logic and control unit (LCU) 24, which may include a digital computer, has a stored program for sequentially actuating the various work stations, or subsystems of the machine 10.

Briefly, a charging station sensitizes the belt 18 by applying a uniform electrostatic charge of predetermined primary voltage $V_0$ to the surface of the belt. The output of the primary charger 28 at the charging station is regulated by a programmable controlled power supply 30, which is in turn controlled by LCU 24 to adjust primary voltage $V_0$ for example through control of electrical potential ($V_{Grid}$) to a grid electrode 28*b* that controls movement of charged ions, created by operation of the charging electrode wires 28*a*, to the surface of the recording member as is well known. In this example the grid wires 28*b* are electrically biased negatively to, for example, between −350 and −750 volts and a nominal bias might be −500 volts.

At an exposure station, projected light from a write head 34 modulates the electrostatic charge on the photoconductive belt 18 to form a latent electrostatic image of a document to be copied or printed. The write head preferably has an array of light-emitting diodes (LEDs) or other light source such as a laser or other exposure source for exposing the photoconductive belt picture element (pixel) by picture element with an intensity regulated in accordance with signals from the LCU to a writer interface 32 that includes a programmable controller. Alternatively, the exposure may be by optical projection of an image of a document onto the photoconductor.

Where an LED or other electro-optical exposure source is used, image data for recording is provided by a data source 36 for generating electrical image signals such as a computer, a document scanner, a memory, a data network. Signals from the data source and/or LCU may also provide control signals to a writer network, etc.

Movement of belt 18 in the direction of the arrow A brings the areas bearing the latent electrostatographic charge images past a development station 38. The toning or development station has one (more if color) or more magnetic brushes in juxtaposition to, but spaced from, the travel path of the belt. Magnetic brush development stations are well known. For example, see U.S. Pat. Nos. 4,473,029 to Fritz et al and 4,546,060 to Miskinis et al.

LCU 24 selectively activates the development station in relation to the passage of the image areas containing latent images to selectively bring the magnetic brush into engagement with or a small spacing from the belt 18. The charged toner particles of the engaged magnetic brush are attracted imagewise to the latent image pattern to develop the pattern which includes development of the patches used for process control.

As is well understood in the art, conductive portions of the development station, such as conductive applicator cylinders, act as electrodes. The electrodes are connected to a variable supply of D.C. potential $V_B$ regulated by a programmable controller 40. Details regarding the development station are provided as an example, but are not essential to the invention.

In this example development will be according to a DAD process wherein negatively charged toner particles selectively develop into relatively discharged areas of the photoconductor. Other types of development stations are well known and may be used.

A transfer station 46, as is also well known, is provided for moving a receiver sheet S into engagement with the photoconductor in register with the image for transferring the image to a receiver sheet such as plain paper or a plastic sheet. Alternatively, an intermediate member may have the image transferred to it and the image may then be transferred to the receiver sheet. In the embodiment of FIG. 1, the transfer station includes a transfer corona charger 47.

Electrostatic transfer of the toner image is effected with a proper voltage bias applied to the transfer charger 47 so as to generate a constant current as will be described below. The transfer charger in this example deposits a positive charge onto the back of the receiver sheet while the receiver sheet engages the toner image on the photoconductor to attract the toner image to the receiver sheet.

After transfer the receiver sheet may be detacked from the belt 18 using a detack corona charger (not shown) as is well known. A cleaning brush 48 or blade is also provided subsequent to the transfer station for removing toner from the belt 18 to allow reuse of the surface for forming additional images. To facilitate or condition remnant toner and other particles for removal by the brush 48 it is conventional to provide a charger device 43 to deposit, in this case, positive charge on the photoconductor to neutralize or reduce electrostatic adhesion of the remnant particles to the belt 18. The voltage to the cleaning-conditioning charger is controlled by a power supply 42. While separate power supplies are shown for each charger it will be appreciated that one supply having multiple taps may be used in lieu of plural charger supplies.

After transfer of the unfixed toner images to a receiver sheet, such sheet is transported to a fuser station 49 where the image is fixed.

A densitometer 76 is operably located intermediate the development station 38 and the transfer station 46. The densitometer 76 used to monitor development of areas of the photoconductive belt 18, as is well known in the art.

A second sensor that is also desirably provided for process control is an electrostatic voltmeter 50. Such a voltmeter is preferably provided after the primary charger 28 to provide readings of measured $V_0$ or $V_{0(m)}$. Outputs of $V_{0(m)}$ and density read by densitometer 76 are provided to the LCU 24 which in accordance with a process control program generates new set point values for $E_0$, $V_0$ and actuation of toner replenishment. Additionally, the process control may be used to adjust transfer current generated by the transfer charger 46 through adjustments to programmable power supply 51. A preferred electrometer is described in U.S. Pat. No. 5,956,544 in the names of Stem et al.

The LCU 24 provides overall control of the apparatus and its various subsystems as is well known. Programming commercially available microprocessors is a conventional skill well understood in the art. The following disclosure is written to enable a programmer having ordinary skill in the art to produce an appropriate control program for such a microprocessor.

In lieu of only microprocessors, the logic operations described herein may be provided by or in combination with dedicated or programmable logic devices. In order to precisely control timing of various operating stations, it is well known to use encoders in conjunction with indicia on the photoconductor to timely provide signals indicative of image frame areas and their position relative to various stations. Other types of control for timing of operations may also be used.

Figure 2:
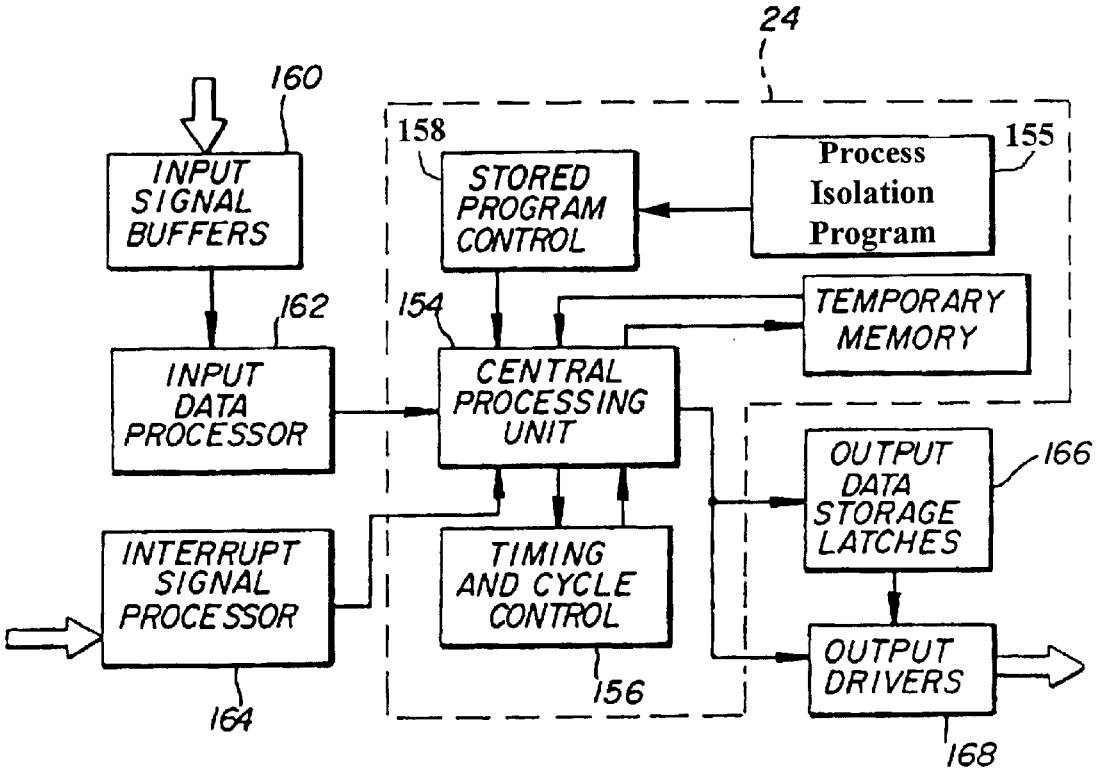
FIG. 2 is a block diagram of a logic and control unit shown in FIG. 1.

Referring to FIG. 2, a block diagram of a typical LCU 24 is shown. The typical LCU 24 includes temporary data storage memory, central processing unit 154, timing and cycle control unit 156, process isolation program 155, and stored program control 158. Data input and output is performed sequentially through or under program control. Input data are applied either through input signal buffers 160 to an input data processor 162 or through an interrupt signal processor 164. The input signals are derived from various switches, sensors, and analog-to-digital converters that are part of the apparatus 10 or received from sources external to machine 10. The output data and control signals are applied directly or through storage latches 166 to suitable output drivers 168. The output drivers are connected to appropriate subsystems.

The LCU 24 includes the "stop and recovery" or "process isolation" routines for stopping the electrophotographic process and returning the machine 10 to a user operable printing configuration. Thus, the LCU 24 provides for the isolation of consecutive image formation steps so that the respective steps may be independently examined. The LCU selectively stops the electrophotographic process at any of a variety of predetermined points under control of the LCU. By stopping the electrophotographic process at any of these preselected points, a field engineer may visually inspect the resulting product and the machine configuration at the terminated point to identify malfunctions of a particular subsystem, or inspect image artifacts.

The stopping of the electrophotographic process by the LCU 24 is distinction from a traditional "hard-stop." A hard stop is a complete stop of the machine. In a hard stop, the operator typically must intervene and perform some recovery steps. The hard stop usually requires the system to completely reconfigure prior to any subsequent operation of the electrophotographic process. In contrast, the stopping points in the process isolation program allows certain aspects of the machine 10 to remain running. Further, the subsequent recovery process requirements of the machine 10 may be substantially reduced in view of the controlled stopping.

Figure 3:
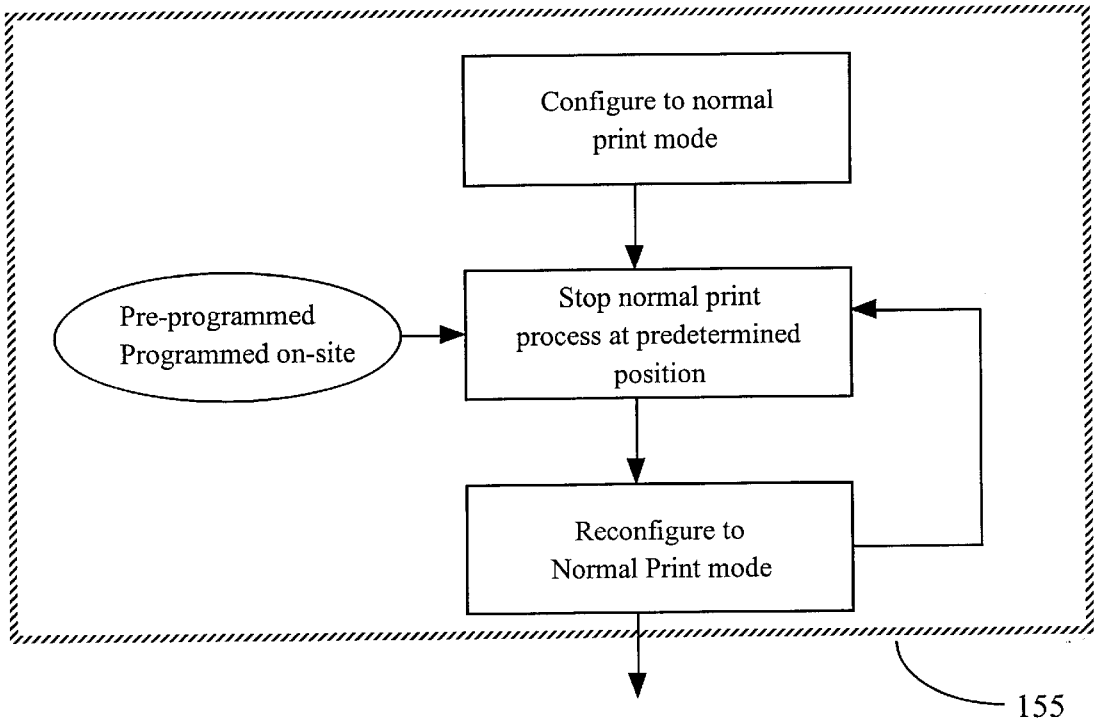
FIG. 3 is a flow chart of the Process Isolation program of FIG. 2.

As shown in FIG. 3, the process isolation program provides for operation of the normal electrophotographic marking process to a predetermined point, where the marking process is terminated from a command from the LCU 24. This is in contrast to hard or emergency stops resulting from a change in the machine, such as a door being opened or a paperjam. As the LCU 24 determines the halting of the marking process, the relevant subsystems are not forced to a hard or emergency stop. In one configuration, the LCU 24 resets the machine 10 to the normal print mode, initiates a subsequent printing and terminates the subsequent printing at a predetermined downstream position from the first termination. Thus, the process isolation program allows for inspection of the marking process product at any of a number of intermediate steps in the marking process. The process isolation program may be configured to automatically provide inspection at a number sequential steps.

Typical stopping points include:

1. Process Patch Stopping (between two consecutive images) at the densitometer. With the process patch stopped at the densitometer 76, the toning of the two adjacent latent images can be visually inspected.
2. Splice Stopping at the splice (between two images) at transfer. This stopping point permits visual inspection of the film splice.
3. Image On Sheet On A Vacuum Transport Stopping. This stopping permits checking the image after transfer.
4. Image On A Sheet In The Fuser Stopping. This permits checking of the image in the fuser.
5. Image On Sheet In The Exit Path Stopping. The stopping permits checking of the image after fusing.

It is contemplated these stopping points may be preprogrammed in the LCU 24 for selection by a field engineer.

In addition, the present invention allows the programming of a stop at any given point in the electrophotographic process. For example, a particular sheet number in a print job may be programmable by the field engineer on-site. Similarly, the selected sheet of the print job may be stopped at any point prior to the registration assembly allowing the inspection of the paper path prior to image transfer.

Similarly, for duplex jobs, a programmable stop may be made for the sheets other than the first few, thereby allowing inspection of the duplex paper path before or after the second transfer.

As the predetermined stop of the electrophotographic process is programmable for any sheet in the job, the inspection of the paper path throughout the finishing equipment is also possible by selecting a print job of appropriate length in conjunction with the selection of the stop sheet. In terms of the present description, the electrophotographic process in the print mode is understood to include the entire paper path, including finishing steps. By controlling both the stopping point and the configuration of the machine at the predetermined stopping point, stress to the machine 10 associated with hard stops is avoided. Similarly, the material handling complications associated with hard stops are also avoided.

The LCU 24 initiated stopping originates from the LCU 24 rather than in response to an intervening event to the machine, such as a door opening, tray removal or user input stop command.

The recovery procedure cooperates with the particular stopping point and may return the machine 10 to a user operable processing status, or sequence to a subsequent stopping by the field engineer.

The invention has been described in detail with particular reference to certain preferred embodiments thereof, but it will be understood that variations and modifications can be effected within the spirit and scope of the invention.

What is claimed is:

1. An electrophotographic marking machine comprising:

a) an image recording member movable in a user operable mode along a closed path and past a series of work stations in a print mode operation culminating in an image fixed to a receiving member;

b) a logic and control unit operable to sequentially actuate each work station during a print mode operation;

c) the logic and control unit configured to stop the movement of the recording member at an intermediate predetermined point in the closed path during a print mode operation thereby interrupting the print mode operation; and d) the logic and control circuit further configured to initiate a continuation of the movement of the recording member from the predetermined point and a continuation of the print mode operation.

2. The electrophotographic marking machine of claim 1, wherein the predetermined point corresponds to one of a number of copies, a time or a position in the paper path.

3. An electrophotograpbic marking machine as in claim 1, wherein the logic and control unit is configured to provide a procedure that initiates a subsequent interruption of the print mode operation at a predetermined downstream location from a first interruption.

4. A electrophotographic marking machine of claim 3 wherein the logic and control unit provides for the reconfiguring of the machine to return the machine to a user operable mode.

5. A method of operating an electrophotographic marking machine having a logic and control unit, comprising:

(a) sequencing the movement of an image recording member through a closed path of travel past a series of workstations under control of the logic and control unit in a print mode wherein the completion of a print mode operation culminates in an image fixed to a receiver;

(b) under control of the logic and control unit, selectively stopping the image recording member at a predetermined point in the closed path and stopping the print mode operation prior to completion of the print mode without the logic and control unit forcing a hard stop of the marking machine; and (c) resting the image recording member from the predetermined point and continuing the print mode operation.

6. The method of claim 5, further comprising reconfiguring the electrophotographic marking machine in response to the stopping at the predetermined point.

7. The method of claim 5, further comprising stopping the electrophotographic process at one of a predetermined number of copies, time or position in a paper path.

8. A method of operating an electrophotographic marking machine, comprising:

(a) moving an image recording member in a print mode operation comprising sequencing the member through a closed path of travel past a series of workstations under control of a logic and control unit wherein each print mode operation culminates in an image fixed to a receiver;

(b) initiating from the logic and control unit a stopping of the recording member at a predetermined point in the closed path of travel that is prior to completion of a print mode operation thereby interrupting the print mode operation; and (c) initiating from the logic and control unit a continuation of the movement of the image recording member from the predetermined point and hereby a continuation of the interrupted print mode operation.

* * * * *